US006962539B2

(12) United States Patent
Sullivan et al.

(10) Patent No.: US 6,962,539 B2
(45) **Date of Patent: *Nov. 8, 2005**

(54) GOLF BALL WITH FILLED COVER

(75) Inventors: Michael J Sullivan, Barrington, RI (US); Derek A Ladd, Acushnet, MA (US)

(73) Assignee: Acushnet Company, Fairhaven, MA (US)

( * ) Notice: Subject to any disclaimer, the term of this patent is extended or adjusted under 35 U.S.C. 154(b) by 6 days.

This patent is subject to a terminal disclaimer.

(21) Appl. No.: 10/671,853

(22) Filed: Sep. 26, 2003

(65) Prior Publication Data

US 2004/0102258 A1 May 27, 2004

Related U.S. Application Data

(63) Continuation of application No. 10/282,713, filed on Oct. 29, 2002, now Pat. No. 6,688,991, which is a continuation-in-part of application No. 09/815,753, filed on Mar. 23, 2001, now Pat. No. 6,494,795.

(51) Int. Cl.[7] ..... A63B 37/00
(52) U.S. Cl. ..... 473/351
(58) Field of Search ..... 473/378, 351, 473/377

(56) References Cited

U.S. PATENT DOCUMENTS

| | | | | |
|---|---|---|---|---|
| 4,085,937 | A | 4/1978 | Schenk | 273/218 |
| 4,836,552 | A | 6/1989 | Puckett et al. | 273/218 |
| 5,026,067 | A | 6/1991 | Gentiluomo | 273/220 |
| 5,482,285 | A | 1/1996 | Yabuki et al. | 273/228 |
| 5,823,889 | A | 10/1998 | Aoyama | 473/374 |
| 5,824,746 | A | 10/1998 | Harris et al. | 525/196 |
| 5,833,553 | A | 11/1998 | Sullivan et al. | 473/374 |
| 5,981,658 | A | 11/1999 | Rajagopalan et al. | 525/72 |
| 6,012,997 | A | 1/2000 | Mason | 473/594 |
| 6,025,442 | A | 2/2000 | Harris et al. | 525/221 |
| 6,057,403 | A | 5/2000 | Sullivan et al. | 525/221 |
| 6,126,559 | A | 10/2000 | Sullivan et al. | 473/378 |
| 6,193,618 | B1 | 2/2001 | Sullivan et al. | 473/373 |
| 6,254,495 | B1 | 7/2001 | Nakamura et al. | 473/371 |
| 6,309,314 | B1 | 10/2001 | Sullivan et al. | 473/378 |
| 6,394,912 | B1 | 5/2002 | Nakamura et al. | 473/371 |
| 6,431,998 | B1 | 8/2002 | Nakamura et al. | 473/371 |
| 6,688,991 | B2 * | 2/2004 | Sullivan et al. | 473/377 |
| 2002/0091188 | A1 | 7/2002 | Statz et al. | 524/400 |

FOREIGN PATENT DOCUMENTS

| | | |
|---|---|---|
| JP | 11-9719 | 1/1999 |
| WO | WO 99/52604 | 10/1999 |
| WO | WO 00/23519 | 4/2000 |
| WO | WO 01/29129 A1 | 4/2001 |
| WO | WO 02/079319 | 10/2002 |

* cited by examiner

*Primary Examiner*—Raeann Gorden
(74) *Attorney, Agent, or Firm*—Kristin D. Wheeler

(57) ABSTRACT

A long distance, low initial spin golf ball is disclosed. The golf ball includes a high moment of inertia core assembly, which may comprise a low specific gravity core and an optional intermediate layer. This sub-assembly is encased within a high specific gravity cover with Shore D hardness in the range of about 40 to about 80. The core is preferably made from a highly neutralized thermoplastic polymer with its specific gravity reduced, and the cover preferably has high specific gravity fillers dispersed therein. The cover is preferably made from thermoset polyurethane or polyurea.

20 Claims, 1 Drawing Sheet

GOLF BALL WITH FILLED COVER

STATEMENT OF RELATED APPLICATION

This patent application is a continuation of U.S. application Ser. No. 10/282,713, filed Oct. 29, 2002, now U.S. Pat. No. 6,688,991 which is a continuation-in-part of U.S. application Ser. No. 09/815,753, filed on Mar. 23, 2001, now U.S. Pat. No. 6,494,795. The parent cases are incorporated herein by reference in their entirety.

FIELD OF THE INVENTION

The present invention relates to golf balls and more particularly, the invention is directed to a high moment of inertia ball with a relatively large core.

BACKGROUND OF THE INVENTION

Conventional golf balls can be divided into two general types or groups: solid balls or wound balls. The difference in play characteristics resulting from these different constructions can be quite significant. These balls, however, have primarily two functional components that make them work. These components are the center or core and the cover. The primary purpose of the core is to be the "spring" of the ball or the principal source of resiliency. The cover protects the core and improves the spin characteristics of the ball.

Two-piece solid balls are made with a single-solid core, usually made of a cross-linked polybutadiene or other rubber, which is encased by a cover. These balls are typically the least expensive to manufacture as the number of components is low and these components can be manufactured by relatively quick, automated molding techniques. In these balls, the solid core is the "spring" or source of resiliency. The resiliency of the core can be increased by increasing the cross-linking density of the core material. As the resiliency increases, however, the compression also increases making a harder ball, which is undesirable. Recently, commercially successful golf balls, such as the Titleist Pro-V1 golf balls, have a relatively large polybutadiene based core, ionomer casing and polyurethane cover, for long distance when struck by the driver clubs and controlled greenside play.

Moreover, the spin rate of golf balls is the end result of many variables, one of which is the distribution of the density or specific gravity within the ball. Spin rate is an important characteristic of golf balls for both skilled and recreational golfers. High spin rate allows the more skilled players, such as PGA professionals and low handicapped players, to maximize control of the golf ball. A high spin rate golf ball is advantageous for an approach shot to the green. The ability to produce and control back spin to stop the ball on the green and side spin to draw or fade the ball substantially improves the player's control over the ball. Hence, the more skilled players generally prefer a golf ball that exhibits high spin rate.

On the other hand, recreational players who cannot intentionally control the spin of the ball generally do not prefer a high spin rate golf ball. For these players, slicing and hooking are the more immediate obstacles. When a club head strikes a ball, an unintentional side spin is often imparted to the ball, which sends the ball off its intended course. The side spin reduces the player's control over the ball, as well as the distance the ball will travel. A golf ball that spins less tends not to drift off-line erratically if the shot is not hit squarely off the club face. The low spin ball will not cure the hook or the slice, but will reduce side spin and its adverse effects on play. Hence, recreational players prefer a golf ball that exhibits low spin rate.

However, the prior art does not disclose a golf ball that has a large core or "spring" and proper weight distribution for controlled spin.

SUMMARY OF THE INVENTION

The present invention is directed to a golf ball with a controlled moment of inertia.

The present invention is also directed to a large core golf ball with a controlled moment of inertia.

The present invention is directed to a golf ball comprising a core and a cover, wherein the ball has a moment of inertia greater than about 0.46 oz·inch$^2$ and wherein the core has a diameter greater than 1.50 inches and comprises a highly neutralized thermoplastic polymer having a specific gravity of less than 1.05 and the cover having a specific gravity of greater than about 1.05, wherein the highly neutralized thermoplastic polymer has its specific gravity reduced, and the cover comprises a polymer with its specific gravity increased.

The cover comprises a polymer selected from a group consisted of polyurethane, ionomer, polyurea, partially or fully neutralized ionomer, metallocene catalyzed polymers, polyesters, polyamides, thermoplastic elastomers, copolyether esters and copolyether-amides. The cover has hardness in the range of about 40 to about 80 on the Shore D scale.

The highly neutralized thermoplastic preferably comprises (a) an ethylene, $C_{3-8}$ alpha, beta-ethylenically unsaturated carboxylic acid copolymer, (b) a high molecular weight, monomeric organic acid or salt thereof and (c) a cation source. This highly neutralized thermoplastic may be blended with (d) a thermoplastic elastomer polymer selected from copolyetheresters, copolyetheramides, block styrene polydiene thermoplastic elastomers, elastomeric polyolefins, and thermoplastic polyurethanes.

Alternatively, the highly neutralized polymer comprises a melt processible thermoplastic composition comprising (a) aliphatic, mono-functional organic acid(s) having fewer than 36 atoms and (b) an ethylene, $C_{3-8}$ alpha, beta-ethylenically unsaturated carboxylic acid copolymer(s) and ionomer(s) thereof.

Alternatively, the highly neutralized polymer comprises (a) a salt of a high molecular weight organic acid and (b) an acid containing copolymer ionomer. This highly neutralized polymer may be blended with (c) a thermoplastic polymer selected from co-polyesteresters, copolyetheramides, block styrene polydiene thermoplastic elastomers, elastomeric polyolefins, and thermoplastic polyurethanes.

Preferably, the diameter of the core is from about 1.50 inches to about 1.66 inches, and the specific gravity of the highly neutralized polymer is reduced by the incorporating low specific gravity fillers into the polymer, or by foaming. The specific gravity of the cover is increased by incorporating high specific gravity fillers therein. Preferably, the specific gravity of the core is less than 1.0, and the specific gravity of the cover is between about 1.05 and about 10.0. More preferably, the specific gravity of the cover is greater than about 2.0.

The golf ball in accordance to the present invention may have the moment of inertia of the golf ball is greater than 0.50 oz·in$^2$, or more preferably greater than about 0.575 oz·in$^2$.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
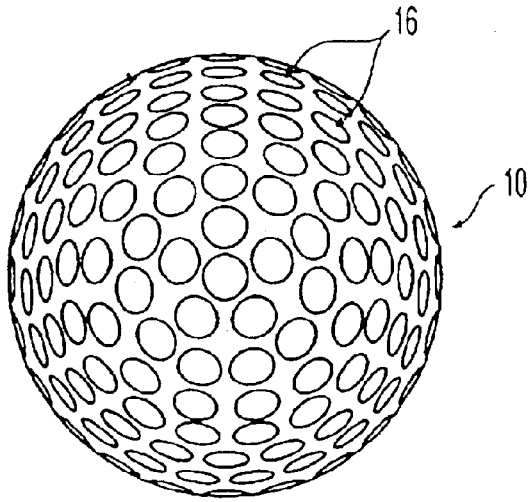
FIG. 1 is a front view of an embodiment of the present invention.
Figure 2:
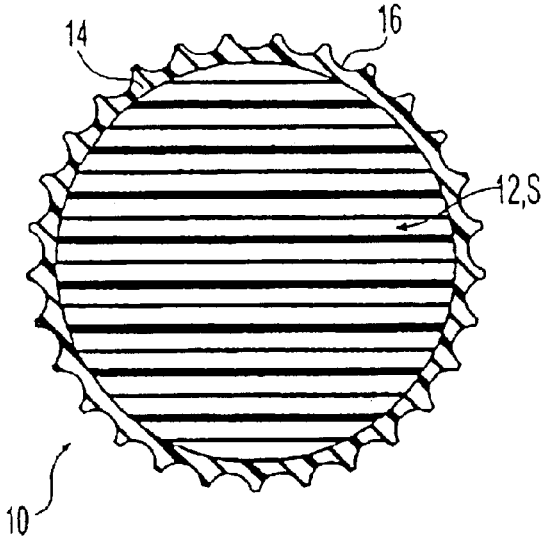
FIG. 2 is a cross-sectional view of a golf ball 10 having inner core 12 and outer cover 14 defining dimples 16.
Figure 3:
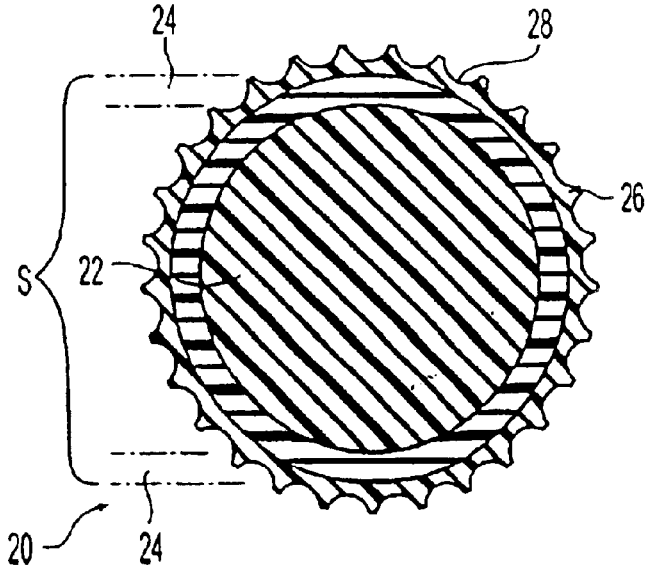
FIG. 3 is a cross-sectional view of a golf ball 20 having inner core 22, an intermediate layer 24 and an outer cover 26 defining dimples 28.

Referring generally to FIGS. 1, 2 and 3 where golf balls 10 and 20 are shown, it is well known that the total weight of the ball has to conform to the weight limit set by the United States Golf Association ("USGA"). Distributing the weight or mass of the ball either toward the center of the ball or toward the outer surface of the ball changes the dynamic characteristics of the ball at impact and in flight. Specifically, if the density is shifted or distributed toward the center of the ball, the moment of inertia is reduced, and the initial spin rate of the ball as it leaves the golf club would increase due to lower resistance from the ball's moment of inertia. Conversely, if the density is shifted or distributed toward the outer cover, the moment of inertia is increased, and the initial spin rate of the ball as it leaves the golf club would decrease due to the higher resistance from the ball's moment of inertia. The radial distance from the center of the ball or from the outer cover, where moment of inertia switches from being increased and to being decreased as a result of the redistribution of weight or mass density, is an important factor in golf ball design.

In accordance to one aspect of the present invention, this radial distance, hereinafter referred to as the centroid radius, is provided. When more of the ball's mass or weight is reallocated to the volume of the ball from the center to the centroid radius, the moment of inertia is decreased, thereby producing a high spin ball. Hereafter, such a ball is referred as a low moment of inertia ball. When more of the ball's mass or weight is reallocated to the volume between the centroid radius and the outer cover, the moment of inertia is increased thereby producing a low spin ball. Hereafter, such a ball is referred as a high moment of inertia ball.

The centroid radius can be determined by following the steps below:

(a) Setting $R_o$ to half of the 1.68-inch diameter for an average size ball, where $R_o$ is the outer radius of the ball.

(b) Setting the weight of the ball to the USGA legal weight of 1.62 oz.

(c) Determining the moment of inertia of a ball with evenly distributed density prior to any weight distribution.

The moment of inertia is represented by $(2/5)(M_t)(R_o^2)$, where Mt is the total mass or weight of the ball. For the purpose of this invention, mass and weight can be used interchangeably. The formula for the moment of inertia for a sphere through any diameter is given in the CRC Standard Mathematical Tables, $24^{th}$ Edition, 1976 at 20 (hereinafter CRC reference). The moment of inertia of such a ball is 0.4572 oz-in$^2$. This will be the baseline moment of inertia value.

(d) Taking a predetermined amount of weight uniformly from the ball and reallocating this predetermined weight in the form of a thin shell to a location near the center of the ball and calculating the new moment of inertia of the weight redistributed ball.

This moment of inertia is the sum of the inertia of the ball with the reduced weight plus the moment of inertia contributed by the thin shell. This new moment of inertia is expressed as $(2/5)(M_r)(R_o^2)+(2/3)(M_s)(R_s^2)$, where Mr is the reduced weight of the ball; $M_s$ is the weight of the thin shell; and Rs is the radius of the thin shell measured from the center of the ball. Also, $M_t=M_r+M_s$. The formula of the moment of inertia from a thin shell is also given in the CRC reference.

(e) Comparing the new moment of inertia determined in step (d) to the baseline inertia value determined in step (c) to determine whether the moment of inertia has increased or decreased due to the reallocation of weight, i.e., subtracting the baseline inertia from the new inertia.

(f) Repeating steps (d) and (e) with the same predetermined weight incrementally moving away from the center of the ball until the predetermined weight reaches the outer surface of the ball.

(g) Determining the centroid radius as the radial location where the moment of inertia changes from increasing to decreasing.

(h) Repeating steps (d), (e), (f) and (g) with different predetermined weights and confirming that the centroid radius is the same for each predetermined weight.

In a preferred embodiment of the present invention, the predetermined weight is initially set at a very small weight, e.g., 0.01 oz, and the location of the thin shell is initially placed at 0.01 inch radially from the center of the ball. The 0.01 oz thin shell is then moved radially and incrementally away from the center.

The results show that for a 1.62-oz ball with a 1.68-inch diameter, the centroid radius is approximately at 0.65 inch (16.5 mm) radially away from the center of the ball or approximately 0.19 inch (4.83 mm) radially inward from the outer surface. In other words, when the reallocated weight is positioned at a radial distance about 0.65 inch, the new moment of inertia of the ball is the same as the baseline moment of inertia of a uniform density ball. To ensure that the preferred method of determining the centroid radius discussed above is a correct one, the same calculation was repeated for predetermined weights of 0.20 oz, 0.405 oz (¼ of the total weight of the ball), 0.81 oz (½ of the total weight) and 1.61 oz (practically all of the weight).

In each case, the centroid radius is located at the same radial distance, i.e., at approximately 0.65 inch radially from the center of a ball weighing 1.62 oz and with a diameter of 1.68 inches, or 0.19 inch from the outer surface of the ball. The procedure for calculating the centroid radius is fully described in the co-pending parent application, which has been incorporated by reference in its entirety.

In accordance to the above calculations, the moment of inertia for a 1.62 oz and 1.68 inch golf ball with evenly distributed weight through any diameter is 0.4572 oz·inch$^2$. Hence, moments of inertia higher than about 0.46 oz·inch$^2$ would be considered as a high moment of inertia ball. For example, a golf ball having a thin shell positioned at about 0.040 inch from the outer surface of the golf ball (or 0.800 inch from the center), has the following moments of inertia.

| Weight (oz) of Thin Shell | Moment of Inertia (oz · inch$^2$) |
|---|---|
| 0.20 | 0.4861 |
| 0.405 | 0.5157 |
| 0.81 | 0.5742 |
| 1.61 | 0.6898 |

For a high moment of inertia ball, the moment of inertia is preferably greater than 0.50 oz·in$^2$ and more preferably greater than 0.575 oz·in$^2$.

In one embodiment, ball 10, as shown in FIG. 2, comprises an inner core assembly S, comprising single core 12, and a cover 14. In accordance to one aspect of the invention, ball 10 is a high moment of inertia ball comprising a low specific gravity inner core 12, encompassed by a high specific gravity cover layer 14. At least a portion of inner core 12 is made with a cellular material, a density reducing filler, hollow microspheres, or is otherwise reduced in density, e.g., foaming. As used herein, the term low specific gravity layer means a layer or a portion of the layer that has its specific gravity reduced by a density reducing filler, hollow microspheres, foaming or other methods. In accordance to one aspect of the present invention, the high density or high specific gravity cover layer 14 is positioned radially outward relative to the centroid radius. Ball 10, therefore, advantageously has a high moment of rotational inertia and low initial spin rates to reduce slicing and hooking when hit with a driver club.

Preferably, the specific gravity of core 12 is less than 1.05 and more preferably less than 1.0. Preferably, the specific gravity of cover layer 14 is greater than 1.05, and more preferably between 1.05 and 1.50 or higher to ensure that the weight of the ball conforms to the 1.62 oz regulation weight. The specific gravity of the cover layer can be as high as about 10.0. The term specific gravity, as used herein, has its ordinary and customary meaning, i.e., the ratio of the density of a substance to the density of water at 4° C., and the density of water at this temperature is 1 g/cm$^3$ or about 0.578 oz/in$^3$. An advantage of the present invention is that the high specific gravity layer, i.e., cover 14, does not need to possess very high density materials, because cover 14 is placed at a significant distance away from the centroid radius. For example, in one preferred embodiment the core has a specific gravity of 0.9 and a diameter of 1.55 inch and the cover has a specific gravity of 1.97 and a thickness of about 0.065 inch. This ball has a moment of inertia of about 0.5077 oz·in$^2$, which is a high moment of inertia ball. Additionally, in the above example to reduce the weight of the ball, e.g., to 1.60 oz, the specific gravity of the cover can be reduced accordingly, e.g., to 1.88, to maintain a high moment of inertia ball.

As stated above, at least a portion of core 12 may comprise a density reducing filler, hollow mircospheres, or otherwise may have its specific gravity reduced, e.g., by foaming the polymer. The effective specific gravity for this low specific gravity layer is preferably less than 1.05 and more preferably less than 1.0. The low specific gravity layer can be made from a number of suitable materials, so long as the low specific gravity layer is durable, and does not impart undesirable characteristics to the golf ball. Preferably, the low specific gravity layer contributes to the soft compression and resilience of the golf ball.

The low specific gravity layer is preferably made from a highly neutralized polymer that has its specific gravity reduced by any methods, such as incorporating cellular resins, low specific gravity filler, hollow fillers or microspheres in the polymeric matrix, where the cured composition has the preferred specific gravity. Alternatively, the polymeric matrix can be foamed to decrease its specific gravity. Preferably, foaming is accomplished by blowing agents, such as nitrogen-based azo compounds. Suitable azo compounds include, but are not limited to, 2,2'-azobis(2-cyanobutane), 2,2'-azobis(methylbutyronitrile), azodicarbonamide, p,p'-oxybis(benzene sulfonyl hydrazide), p-toluene sulfonyl semicarbazide, p-toluene sulfonyl hydrazide. These blowing agents are commercially available from Crompton Uniroyal Chemical in the United States and the United Kingdom, and from Hepce Chemical in Korea, among others. Any agent that releases gas at certain temperatures and pressures can be used to foam the core material.

The preferred highly neutralized polymer for core 12 is a thermoplastic polymer or copolymer that has at least 80% and preferably 100% of the acid contained therein neutralized. Such highly neutralized polymers or copolymers are disclosed in U.S. patent application Publication No. 2002/0091188, PCT International Publication nos. WO 01/29129 and WO 00/23519. The disclosures of these three references are incorporated by reference in their entireties.

More specifically, suitable highly neutralized polymers include, but are not limited to, composition comprising (a) an ethylene, $C_{3-8}$ alpha, beta-ethylenically unsaturated carboxylic acid copolymer, (b) a high molecular weight, monomeric organic acid or salt thereof, and (c) a cation source. Preferably, (c) is present at a level sufficient to neutralize the combined acid content of (a) and (b). This highly neutralized polymer can also be blended with (d) a thermoplastic elastomer polymer selected from copolyetheresters, copolyetheramides, block styrene polydiene thermoplastic elastomers, elastomeric polyolefins, and thermoplastic polyurethanes. In this example, component (b) is present at about 10 to about 45 weight percent (wt. %) of (a), (b) and (d) provided that component (b) does not exceed 50 wt. % of (a) plus (b); and component (d) is present at about 1 to about 35 wt. % of (a), (b) and (d).

Another suitable highly neutralized composition includes (a) a salt of a high molecular weight organic acid and (b) an acid containing copolymer ionomer. This highly neutralized polymer may be blended with (c) a thermoplastic polymer selected from co-polyesteresters, copolyetheramides, block styrene polydiene thermoplastic elastomers, elastomeric polyolefins, and thermoplastic polyurethanes.

Suitable highly neutralized polymers also include a melt processible thermoplastic composition of a highly neutralized ethylene acid copolymer. This composition preferably comprises (a) aliphatic, mono-functional organic acid(s) having fewer than 36 atoms and (b) an ethylene, $C_{3-8}$ alpha, beta-ethylenically unsaturated carboxylic acid copolymer(s) and ionomer(s) thereof. More preferably, this composition is a melt-processible highly neutralized polymer of ethylene, $C_{3-8}$ alpha, beta-ethylenically unsaturated carboxylic acid copolymers that have their crystallinity disrupted by addition of a softening monomer or other means, such as high acid levels, and a non-volatile, non-migratory agents such as organic acids or salts selected for their ability to substantially or totally suppress any remaining ethylene crystallinity.

Other suitable highly neutralized polymers include those disclosed in commonly owned co-pending patent application entitled "Golf Balls Comprising Highly-Neutralized Acid Polymers" bearing Ser. No. 10/118,719 filed on Apr. 9, 2002. The disclosure of this application is hereby incorporated by referenced in its entirety. This highly neutralized polymer contains an acid group neutralized by an organic acid or a salt thereof, the organic acid or salt thereof being present in an amount sufficient to neutralize the polymer by at least about 80%. This polymer may comprise ionomeric copolymers and terpolymers, ionomer precursors, thermoplastics, thermoplastic elastomers, polybutadiene rubber, balata, grafted metallocene-catalyzed polymers, non-grafted metallocene-catalyzed polymers, single-site polymers, high-crystalline acid polymers, cationic ionomers, and mixtures thereof. The organic acid may be selected from the group consisting of aliphatic organic acids, aromatic organic acids, saturated mono-functional organic acids, unsaturated mono-functional organic acids, and multi-unsaturated mono-functional organic acids. Preferably, the salt of organic acids comprise the salts of barium, lithium, sodium, zinc, bismuth, chromium, cobalt, copper, potassium, strontium, titanium, tungsten, magnesium, cesium, iron, nickel, silver, aluminum, tin, calcium, stearic, bebenic, erucic, oleic, linoelic, dimerized derivatives, and mixtures thereof.

In this example, the core may further comprise a second polymer component in an amount sufficient to reduce the core compression. It is also preferred that the second polymer component comprises ionomeric copolymers and terpolymers, ionomer precursors, thermoplastics, thermoplastic elastomers, thermoset elastomers, grafted metallocene-catalyzed polymers, non-grafted metallocene-catalyzed polymers, single-site polymers, high-crystalline acid polymers, cationic ionomers, and mixtures thereof. At least one of the polymer or second polymer component is partially neutralized by a metal cation.

Suitable highly neutralized core polymers further include those disclosed in PCT International Publication no. WO 02/079319. This reference discloses highly neutralized ethylene/carboxylic acid/alkyl (meth)acrylate copolymers and terpolymers that exhibit low flexural modulus, as measured in accordance to ASTM D6272-98 about two weeks after the test specimen are prepared, and high melt index, as measured in accordance to the ASTM D 1238 standard. These polymers can also be used in the cover.

These preferred highly neutralized polymeric compositions have their specific gravity reduced by the methods described above so that core 12 has the preferred specific gravity of less than 1.05, in accordance to the present invention. The preferred compositions are highly resilient polymers that also exhibit compression in the range of about 40 to about 120 PGA, more preferably about 60 to about 100 PGA, and most preferably about 65 to about 90 PGA. Cores made in accordance to the present invention obtain coefficient of restitution of at least 0.780, preferably at least 0.800 and more preferably at least 0.810 at the colliding speed between the core and an impacting plate of about 125 feet per second.

Highly neutralized polymers can be blended with other known golf ball materials, such as ionomers, polyamides, polyurethanes, and polyureas, among those listed as being capable of blending with highly neutralized polymers in commonly owned, co-pending patent application Ser. No. 10/118,719, which has already been incorporated by reference. Alternatively, core 12 may comprise a foamed composition formed from a saponified polymer blended with a metallocene catalyzed polymer. Such composition is fully disclosed in commonly owned PCT International Publication no. WO 99/52604, which is hereby incorporated by reference in its entirety.

The cover layer 14 is preferably a urethane or urea polymer with its specific gravity increased with high density fillers. The outer cover layer is formed from a relatively soft thermoset material in order to replicate the soft feel and high spin play characteristics of a balata ball when the balls of the present invention are used for pitch and other "short game" shots. In particular, the outer cover layer should have a Shore D hardness from about 40 to about 80, preferably 35–50 and most preferably 40–45, as measured in accordance to ASTM D 2240-00 standard. Additionally, the materials of the outer cover layer must have a degree of abrasion resistance in order to be suitable for use as a golf ball cover. The outer cover layer of the present invention can comprise any suitable thermoset material which is formed from a castable reactive liquid material. The preferred materials for the outer cover layer include, but are not limited to, thermoset polyurethanes, thermoset urethane ionomers, thermoset urethane epoxies and thermoset polyureas or polyurethane-ureas. Examples of suitable polyurethane ionomers are disclosed in U.S. Pat. No. 5,692,974 entitled "Golf Ball Covers," the disclosure of which is hereby incorporated by reference in its entirety in the present application.

Alternatively the cover may comprise a thermoplastic polyurethane, polyurea, partially or fully neutralized ionomer, metallocene or other single site catalyzed polymer, polyester, polyamide, non-ionomeric thermoplastic elastomer, copolyether-esters, copolyether-amides, polycarbonate, polybutadiene, polyisoprene, polystryrene block copolymers such as styrenebutadiene-styrene, styrene-ethylene-prooylene-styrene, styrene-ethylene-butylene-styrene, etc. and blends thereof.

Thermosetting polyurethanes or polyureas are particularly preferred for the outer cover layers of the balls of the present invention. Polyurethane is a product of a reaction between polyurethane prepolymer and a curing agent. The polyurethane prepolymer is a product formed by a reaction between a polyol and a diisocyanate. The curing agent is typically either a diamine or glycol. Often a catalyst is employed to promote the reaction between the curing agent and the polyurethane prepolymer. Thermosetting polyurethanes or polyureas can also be formed into a cover by a reaction injection molding technique.

Conventionally, thermoset polyurethanes are prepared using a diisocyanate, such as 2,4-toluene diisocyanate (TDI) or methylenebis-(4-cyclohexyl isocyanate) (HMDI) and a polyol which is cured with a polyamine, such as methylenedianiline (MDA), or a trifunctional glycol, such as trimethylol propane, or tetrafunctional glycol, such as N,N,N',N'-tetrakis(2-hydroxpropyl)ethylenediamine. However, the present invention is not limited to just these specific types of thermoset polyurethanes. Quite to the contrary, any suitable thermoset polyurethane or polyurea may be employed to form the outer cover layer of the present invention.

Cover 14 may have its specific gravity increased by the inclusion of a high density metal or from metal powder encased in a polymeric binder. High density metals such as steel, tungsten, lead, brass, bronze, copper, nickel, molybdenum, or alloys may be used. Fillers with very high specific gravity such as those disclosed in U.S. Pat. No. 6,287,217 at columns 31–32 can also be incorporated into the cover. Fillers may also be used to reinforce the cover to improve durability. Suitable reinforcing fillers and composites include, but not limited to, carbon including graphite, glass, aramid, polyester, polyethylene, polypropylene, silicon carbide, boron carbide, natural or synthetic silk.

The thickness of the outer cover layer is important to the performance of the golf balls. If the outer cover layer is too thick, this cover layer will contribute to the in-flight characteristics related to the overall construction of the ball and not the cover surface properties. However, if the outer cover layer is too thin, it will not be durable enough to withstand repeated impacts by the golfer's clubs. It has been determined that the outer cover layer should have a thickness of less than about 0.05 inch, preferably between about 0.01 and about 0.04 inch. Most preferably, this thickness is about 0.03 inch.

In accordance to another aspect of the present invention, core 12 is a relatively large core having a diameter is the range of about 1.50 inches to about 1.66 inches. In other words, the volume of core 12 preferably occupies about 80% to about 97.5% of the volume of ball 10 (disregarding the volume of the dimples). This maximizes the "spring" available to propel the ball when impacted by a driver club.

In accordance to another embodiment of the present invention, ball 20, as shown in FIG. 3, has an inner assembly S, comprising inner core 22 and at least one intermediate layer 24, and a cover 26. Intermediate layer 24 can be an inner cover layer, wherein both inner cover layer 24 and outer cover layer 26 have their specific gravity increased by the inclusion of high specific gravity fillers.

Intermediate layer 24 can also be an outer core layer, wherein at least one of inner core 22 or outer core layer 24 comprises the preferred foamed highly neutralized polymers described above. On the other hand, core layers 22 and 24 may have their specific gravity reduced to different levels. For example, inner core 22 may have a specific gravity reduced to about 0.80 and a diameter of 1.50 inches, and the outer core 24 may have its specific gravity reduced to about 0.90 and a thickness of about 0.040 inch and cover 26 has sufficient fillers to bring ball 20 to any desired final weight, e.g., 1.62 oz.

In another embodiment, inner core 22 comprises foamed highly neutralized polymer and cover 26 comprises foamed polyurethane, while intermediate layer 24 is a thin dense layer. Thin dense layers are fully disclosed in the co-pending parent patent application, which has already been incorporated in its entirety. As defined in the parent application, a thin dense layer preferably has thickness in the range of about 0.001 inch to about 0.050 inch and specific gravity of greater than 1.2, more preferably more than 1.5, even more preferably more than 1.8 and most preferably more than 2.0. Preferably, thin dense layer is located as close as possible to the outer surface of the golf ball.

As used herein, compression is measured by applying a spring-loaded force to the golf ball center, golf ball core or the golf ball to be examined, with a manual instrument (an "Atti gauge") manufactured by the Atti Engineering Company of Union City, N.J. This machine, equipped with a Federal Dial Gauge, Model D81-C, employs a calibrated spring under a known load. The sphere to be tested is forced a distance of 0.2 inch (5 mm) against this spring. If the spring, in turn, compresses 0.2 inch, the compression is rated at 100; if the spring compresses 0.1 inch, the compression value is rated as 0. Thus more compressible, softer materials will have lower Atti gauge values than harder, less compressible materials. Compression measured with this instrument is also referred to as PGA compression. The approximate relationship that exists between Atti or PGA compression and Riehle compression can be expressed as:

(Atti or PGA compression)=(160-Riehle Compression).

Thus, a Riehle compression of 100 would be the same as an Atti compression of 60.

The coefficient of restitution (CoR) is the ratio of the relative velocity between two objects after direct impact to the relative velocity before impact. As a result, the CoR can vary from 0 to 1, with 1 being equivalent to a perfectly or completely elastic collision and 0 being equivalent to a perfectly plastic or completely inelastic collision. Since a ball's CoR directly influences the ball's initial velocity after club collision and travel distance, golf ball manufacturers are interested in this characteristic for designing and testing golf balls.

One conventional technique for measuring CoR uses a golf ball or golf ball subassembly, air cannon, and a stationary steel plate. The steel plate provides an impact surface weighing about 100 pounds or about 45 kilograms. A pair of ballistic light screens, which measure ball velocity, are spaced apart and located between the air cannon and the steel plate. The ball is fired from the air cannon toward the steel plate over a range of test velocities from 50 ft/s to 180 ft/sec. As the ball travels toward the steel plate, it activates each light screen so that the time at each light screen is measured. This provides an incoming time period proportional to the ball's incoming velocity. The ball impacts the steel plate and rebounds though the light screens, which again measure the time period required to transit between the light screens. This provides an outgoing transit time period proportional to the ball's outgoing velocity. The coefficient of restitution can be calculated by the ratio of the outgoing transit time period to the incoming transit time period, $CoR=T_{out}/T_{in}$.

Another CoR measuring method uses a titanium disk. The titanium disk intending to simulate a golf club is circular, and has a diameter of about 4 inches, and has a mass of about 200 grams. The impact face of the titanium disk may also be flexible and has its own coefficient of restitution, as discussed further below. The disk is mounted on an X-Y-Z table so that its position can be adjusted relative to the launching device prior to testing. A pair of ballistic light screens are spaced apart and located between the launching device and the titanium disk. The ball is fired from the launching device toward the titanium disk at a predetermined test velocity. As the ball travels toward the titanium disk, it activates each light screen so that the time period to transit between the light screens is measured. This provides an incoming transit time period proportional to the ball's incoming velocity. The ball impacts the titanium disk, and rebounds through the light screens which measure the time period to transit between the light screens. This provides an outgoing transit time period proportional to the ball's outgoing velocity. CoR can be calculated from the ratio of the outgoing time period to the incoming time period along with the mass of the disk and ball:

$$CoR = \frac{(T_{out}/T_{in}) \times (M_e + M_b) + M_b}{M_e}$$

While various descriptions of the present invention are described above, it is understood that the various features of the present invention can be used singly or in combination thereof. Therefore, this invention is not to be limited to the specifically preferred embodiments depicted therein.

What is claimed is:

1. A golf ball comprising a core and a cover, wherein the ball has a moment of inertia greater than about 0.46 oz·inch$^2$ and wherein the core has a diameter greater than 1.50 inches and comprises a highly neutralized thermoplastic polymer having a specific gravity of less than 1.05 and the cover having a specific gravity of greater than about 1.05.

2. The golf ball of claim 1, further comprising an intermediate layer.

3. The golf ball of claim 2, wherein the intermediate layer is an inner cover and comprised of high specific gravity filler.

4. The golf ball of claim 2, wherein the intermediate layer is an outer core layer and has its specific gravity reduced.

5. The golf ball of claim 1, wherein the highly neutralized thermoplastic Comprises (a) an ethylene, $C_{3-8}$ alpha, beta-ethylenically unsaturated carboxylic acid copolymer, (b) a high molecular weight, monomeric organic acid or salt thereof (c) a cation source and (d) a thermoplastic elastomer polymer selected from copolyetheresters, copolyetheramides, block styrene polydiene thermoplastic elastomers, elastomeric polyolefins, and thermoplastic polyurethanes.

6. The golf ball of claim 1, wherein the highly neutralized polymer comprises a melt processible thermoplastic composition comprising (a) aliphatic, mono-functional organic acid(s) having fewer than 36 atoms and (b) an ethylene, $C_{3-8}$ alpha, beta-ethylenically unsaturated carboxylic acid copolymer(s) and ionomer(s) thereof.

7. The golf ball of claim 1, wherein the highly neutralized polymer comprises (a) a salt of a high molecular weight organic acid and (b) an acid containing copolymer ionomer.

8. The golf ball of claim 7, wherein the highly neutralized polymer further comprises (c) a thermoplastic polymer selected from co-polyesteresters, copolyetheramides, block styrene polydiene thermoplastic elastomers, elastomeric polyolefins, and thermoplastic polyurethanes.

9. The golf ball of claim 1, wherein the diameter of the core is from about 1.50 inches to about 1.66 inches.

10. The golf ball of claim 1, wherein the specific gravity of the highly neutralized polymer is reduced by the incorporating low specific gravity fillers into the polymer.

11. The golf ball of claim 1, wherein the specific gravity of the highly neutralized polymer is reduced by foaming.

12. The golf ball of claim 1, wherein the specific gravity of the cover is increased by incorporating high specific gravity fillers therein.

13. The golf ball of claim 1, wherein the specific gravity of the core is less than 1.0.

14. The golf ball of claim 1, wherein the specific gravity of the cover is between about 1.05 and about 10.0.

15. The golf ball of claim 1, wherein the specific gravity of the cover is greater than about 2.0.

16. The golf ball of claim 1, wherein the moment of inertia of the golf ball is greater than 0.50 $oz \cdot in^2$.

17. The golf ball of claim 14, wherein the moment of inertia of the golf ball is greater than about 0.575 $oz \cdot in^2$.

18. A golf ball comprising a core, an intermediate layer and a cover, wherein the ball has a moment of inertia greater than about 0.46 $oz \cdot inch^2$ and wherein the core has a diameter greater than 1.50 inches and comprises a highly neutralized thermoplastic polymer and the cover having a specific gravity of greater than about 1.05.

19. The golf ball of claim 18, wherein the intermediate layer is an inner cover and is comprised of high specific gravity filler.

20. The golf ball of claim 19, wherein the intermediate layer is an outer core and has its specific gravity reduced.

* * * * *